United States Patent [19]

Yli-Vakkuri

[11] 4,266,413

[45] May 12, 1981

[54] MEANS FOR WASHING CELLULOSE PULP

[75] Inventor: Erkki Yli-Vakkuri, Savonlinna, Finland

[73] Assignee: Enso-Gutzeit Osakeyhtö, Finland

[21] Appl. No.: 114,501

[22] Filed: Jan. 23, 1980

[30] Foreign Application Priority Data

Jan. 26, 1979 [FI] Finland ..... 790251

[51] Int. Cl.[3] ..... D21C 9/06

[52] U.S. Cl. ..... 68/158; 68/181 R; 162/380; 210/404

[58] Field of Search ..... 68/18 F, 148, 158, 181 R; 210/404; 8/156; 162/60, 380

[56] References Cited

U.S. PATENT DOCUMENTS

| | | | |
|---|---|---|---|
| 2,741,369 | 4/1956 | Fest | 210/404 X |
| 3,487,941 | 1/1970 | Haapamaki | 210/404 |
| 3,807,202 | 4/1974 | Gunkel | 68/181 R |

FOREIGN PATENT DOCUMENTS

| | | | |
|---|---|---|---|
| 11850 | 4/1956 | Fed. Rep. of Germany | 210/404 |
| 71432 | 12/1946 | Norway | 162/60 |
| 314535 | 12/1971 | U.S.S.R. | 210/404 |

*Primary Examiner*—Philip R. Coe

*Attorney, Agent, or Firm*—Toren, McGeady and Stanger

[57] ABSTRACT

Apparatus for washing cellulose pulp including a drum with a filtering member on its outer shell and stationary housings encircling the drum. A pressurized washing liquid is applied against the cellulose pulp which is in the form of a fiber web upon the filtering member and compartments affixed within the drum receive a suspension liquid displaced from the washing liquid. Pure washing liquid introduced against the rotation of the drum is applied against the fiber web forcing suspension liquid to pass through the filter and into compartments under the housing. A valve combines the suspension liquid flow from the compartments and conducts the flow to a supply connector at the next-to-last housing taken in the direction of rotation of the drum. This displaced suspension liquid displaces liquid from the pulp web with flow resistances encountered by the washing liquid between different housings causing pressure differential between washing liquids in different housings. Leakage of washing liquid caused directly from one housing to the next or leakage of suspension liquid displaced from within the fiber web is inhibited by radial lamellae cooperating with the drum and unperforated zones adjacent the housings. Spacing of the lamellae on the drum circumference is less than the length of the unperforated zone so that during drum rotation there is at least one lamella in sealing contact with each unperforated zone located between the housing walls.

5 Claims, 6 Drawing Figures

MEANS FOR WASHING CELLULOSE PULP

Figure 1:
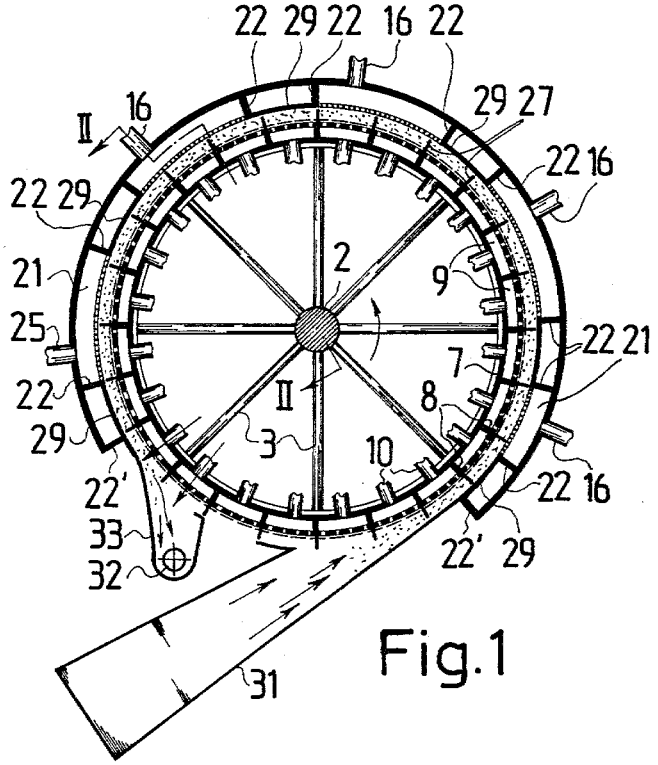

The present invention concerns a means for the washing of cellulose pulp, from a cellulose pulp layer present in the from of a continuous web being removed, for instance, the wasted liquor produced in the cellulose digesting process by displacing same on the surface of a water-permeable drum in that that from housings encircling the drum is introduced into the pulp web, while the drum is rotating, a pressurized washing liquid, which by effect of pressure pushes out its way an equivalent quantity of the wasted liquor residing in the cellulose layer.

The following are some of the requirements which are imposed on an efficient displacement washing procedure for cellulose present in the form of a continuous fibre web.

1. The fibre web from which suspension fluid is being displaced shall have a homogeneous structure.
2. The fibre web shall have a uniform thickness.
3. The displacement of suspension fluid shall take place under high pressure, that is there shall be a high differential pressure between the side of the fibre web contacted by the washing liquid and that side on which the displaced liquid escapes.
4. The dry matter content of the fibre web shall be high throughout the displacement process.
5. The washing liquid must not cause any internal movement between fibres.

The above requirements are met by procedures disclosed in the prior art wherein the cellulose is washed in the form of a continuous web in that the web formed in a separate concentrating zone is treated in a washing zone comprising between 2 and 6 washing steps and wherein the washing proceeds according to the counter-current principle so that a pure washing liquid under pressure is only introduced into the last washing zone in the direction of propagation of the web, and this liquid as it penetrates through the web displacing therefrom an equivalent amount of suspension fluid, which while being all the time under the effect of pressure from the pure washing fluid in its turn displaces suspension liquid from the web portion residing in the last but one washing step, and this liquid further passing into the next washing step. The procedure is mainly characterized in that only one pumping is employed for transporting the washing liquid over a plurality of washing zones.

The procedure mentioned above is carried out with the aid of a means comprising a foraminous drum covered with a wire fabric and encircled by stationary pressure housings for the feeding of washing liquid into the pulp web on the surface of the drum. When only one pumping is employed for transporting the washing liquid from one washing step (that is, from one washing liquid-supplying housing) to another, different pressures will prevail in each housing, owing to the pumping resistances, this pressure being highest in the housing which is last in the direction of propagation of the web (that is, in the housing of the pure washing liquid) and lowest in that housing which is first in the direction of propagation of the web. In order that the transport of washing liquid from any one housing under higher pressure into the adjacent housing with lower pressure without passage of the washing liquid through the pulp web might be inhibited, the housings have to be mutually isolated in pressure-tight fashion by partitions, since when washing liquid is impressed against the pulp web this web will be slightly compressed against the wire fabric and a thin liquid film will be formed between the pulp web and the bottom of the housing and which, being under pressure, will tend to travel in the direction of lower pressure.

In the means of the patent application cited, the sealing between housings has been accomplished in that to the partitions between housings have been affixed resilient flaps urged by the pressure by one end freely against the pulp web and which have been disposed in each case in the direction of rotation of the drum on the side of the housing carrying higher pressure, so that by effect of the pressure the flaps will be urged against the pulp web, thereby interrupting the liquid film at the partition.

But unavoidably there remain, between the fibre web and the flaps, minimal gaps caused by the unevenness of the fibre web surface and through which the washing liquid may travel past the partitions and into the housing carrying lower pressure, with the consequence of impaired washing result because part of the dirtier suspension liquid contained in the fibre web fails to be displaced and remains in the web. If the washing means is operated at high pressure, the leakage from housing to housing may have a magnitude which cannot be accepted if a good washing result is aspired.

The object with the means of the present invention is to meet the requirements imposed on efficient washing of a fibre web, stated above under 1 to 5, without incurring the above-mentioned detriment observable in the operation of the washing means.

The aim stated above is achieved with the means specified in the claims hereto attached.

Figure 2:
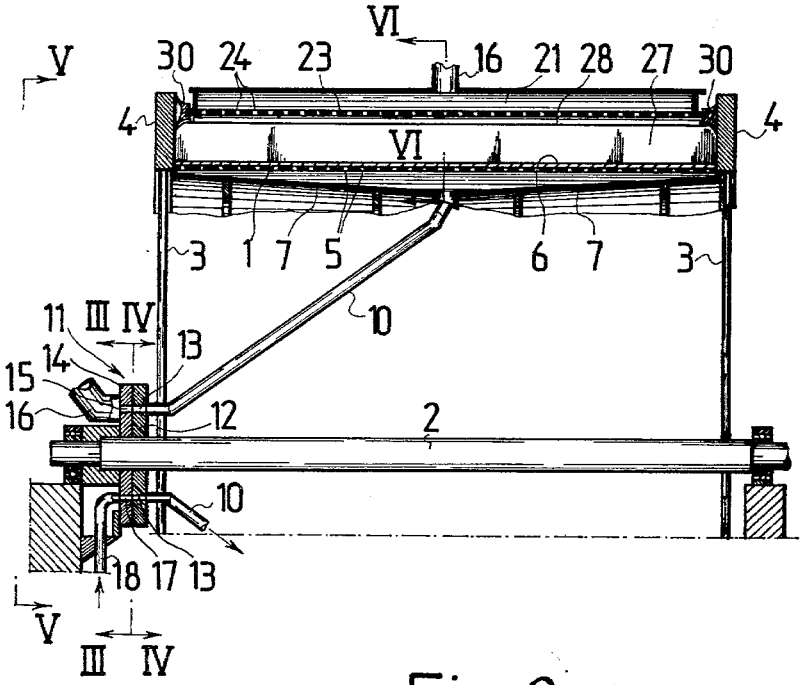
Figure 3:
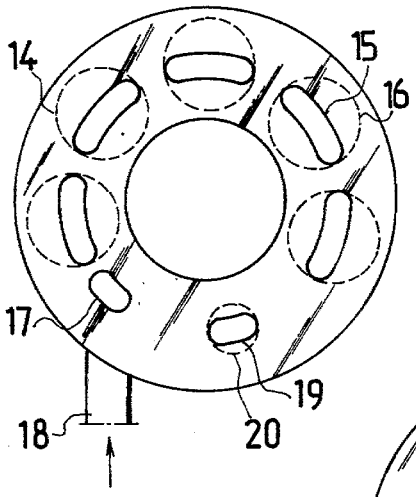
Figure 4:
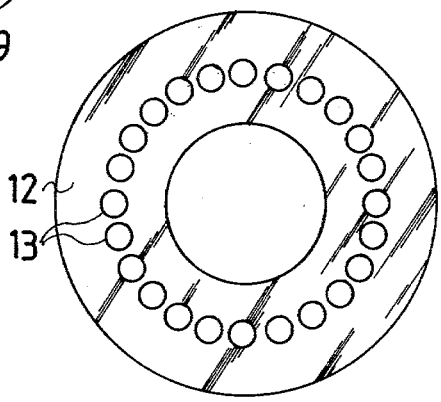
Figure 5:
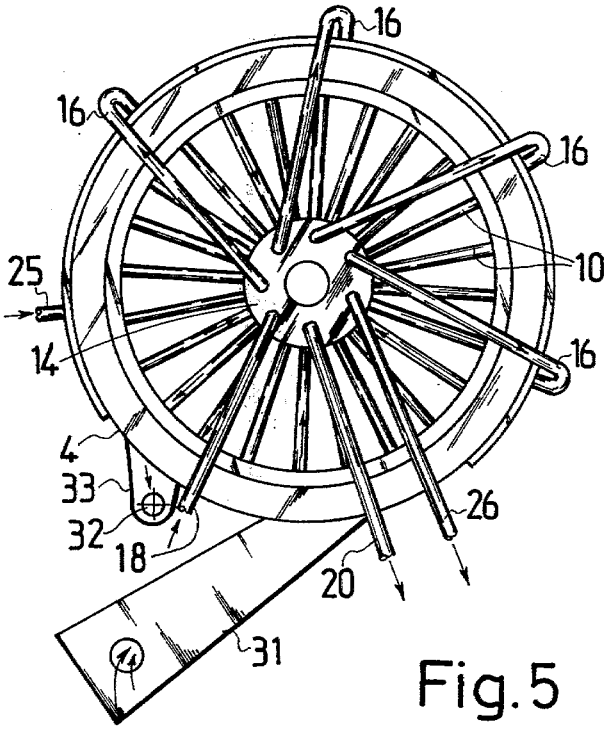
Figure 6:
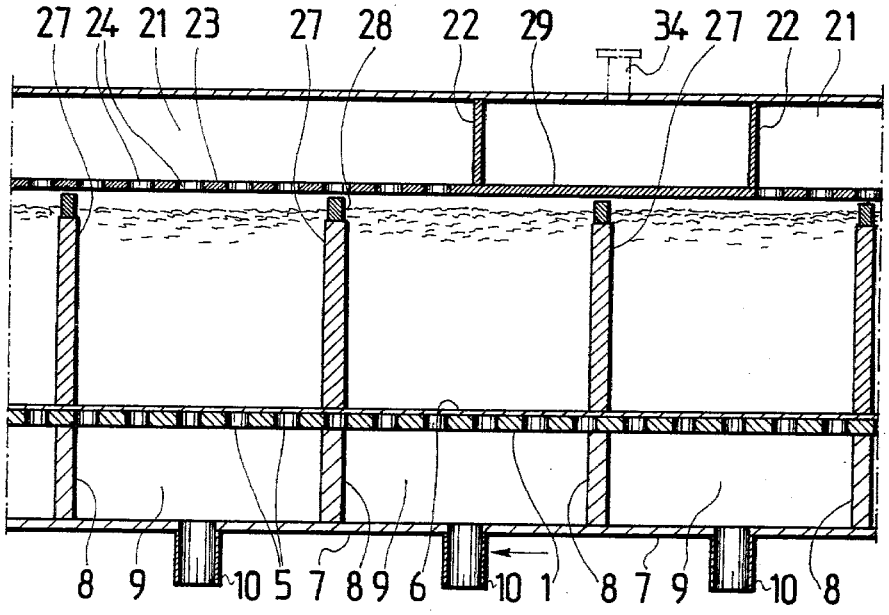

In the following, the means according to the present invention for washing cellulose pulp is illustrated by means of a drawing, wherein FIG. 1 presents the means in sectional representation, FIG. 2 shows of the means the longitudinal secton carried along the line II—II in FIG. 1, FIG. 3 shows the cross section viewed in the direction of line III—III in FIG. 2, FIG. 4 shows the section viewed in the direction of line IV—IV in FIG. 2, FIG. 5 shows the end view viewed in the direction of line V—V in FIG. 2, and FIG. 6 displays the enlarged sectional view along the line VI—VI in FIG. 2.

The washing means of the invention comprises a drum 1 open at both ends and provided with a horizontal central shaft 2. The shaft is affixed at both ends by radial rods 3 to annular disks 4 on the periphery of the drum 1. The shell of the drum 2 has been provided with perforations 5 and thereupon lies the filtering member proper 6, which is preferably a wire fabric of plastic or metal. Under the foraminous outer shell of the drum 1 is found, spaced therefrom, an inner shell 7, this shell being likewise attached to the annular disks 4. The inner shell 7 has, as shown in FIG. 2, the shape of a double cone, sloping from the ends of the drum 1 towards its centre. The volume remaining between the outer shell and inner shell 7 of the drum 1 is divided by partitions (8) parallelling the radius of the drum and having the same length as the drum, into compartments 9 of uniform size. Each compartment 9 has been connected from its largest cross section part in the center, by a pipe 10, to a draining valve 11 at one end of the shaft 2.

As shown in FIG. 2, the draining valve 11 comprises a valve half 12 affixed to the shaft and therefore rotating therewith, this half of the valve being annular (FIG. 4) and provided with round apertures 13, which are in register with the pipes 10 attached to the valve half 12 and which have a diameter consistent with that of the pipes 10.

The stationary half 14 of the valve 11 has been provided with elongated apertures 15 as shown in FIG. 3, these apertures being in register with the apertures 13 in the radial direction of the valve 11 and having a height consistent with the diamater of the apertures 13. The length of each aperture 15 is such that the area of the aperture 15 is equivalent to the aggregate area of several apertures 13, so that each aperture 15 communicates with several (in FIGS. 3 and 4, three) apertures 13 and pipes 10 connected therewith. The lands between apertures 15 have the same dimension as the diameter of the aperture 13. The number of apertures 15 is the same as the number of washing zones in the means, and each aperture communicates with a pipe 16 having a diameter consistent with that of the aperture 15. These pipes 16 departing from the outer surface of the valve 11 connect the different washing steps with each other (FIG. 5). In addition, the valve half 14 presents a smaller elongated aperture 17 communicating with a compressed air pipe 18, and a draining aperture 19 communicating with a draining pipe 20 (FIG. 5).

The washing steps under pressure are constituted, as shown in FIG. 1, by stationary housings 21 located outside the drum 1, spaced therefrom, and mutually isolated in the circumferential direction of the drum by front and rear walls 22 having the same length as the drum. The bottom plates 23 of the housings 21 facing the surface of the drum 1 have been made curved in keeping with the drum surface and they have been provided with a comparatively close perforations 24. The different housings 21 have been mutually connected by means of pipes 16, and the housing which is last in the direction of rotation of the drum has been provided with an input connector 25, and the suspension liquid displaced from the fibre web by the washing liquid introduced from the first housing 21 departs through the drain pipe 26 attached to the stationary half 14 of the valve 11 (FIG. 5). As shown in FIG. 1, the number of housings is five, but their number may vary between 2 and 6, depending on the desired washing capacity.

The pressures are different in each housing 21, in such manner that the pressure is highest in the housing which is last in the direction of rotation of the drum 1, whence it decreases owing to flow resistances on transition from each housing to the next, so that the lowest pressure prevails in the first housing. However, the pressure is sufficient to slightly compress the fibre web, whereby a thin film of washing liquid is established between the fibre web and the bottom 23 of the housing 21, which in a way serves as lubricant enabling the fibre web to slide easily forward, without fouling the bottoms 23 of the housings 21. In order to avoid leakages from housing to housing through this washing liquid film, a sealing must be provided at the walls 22. Sealing is effected in a simple manner, using the arrangement illustrated on an enlarged scale in FIG. 6. The drum 1 carries on its surface lamellae 27, attached to annular rails 4 and having the same length as the drum and parallelling its radius, these lamellae dividing the pulp layer upon the drum surface into equal-sized compartments and being located on the continuations of the partitions 8, whereby leakage from one compartment 9 to the other is inhibited. Against the bottoms 23 of the housings 21, the lamellae 27 have been provided on their ends with resilient sealing strips 28 of a wear-resistant material and which drag against the bottom plate 23 as the drum rotates.

Each bottom plate 23 presents in the direction of rotation of the drum 1, between the front and rear walls 22 of the housings, an unperforated zone 29 with a length greater than the spacing between lamellae 27, whereby there will be at least one lamella 27 at each unperforated zone 29, its top edge provided with a sealing strip 28 of a resilient, wear-resistant material, which as it presses tightly against the zone 29 prevents leakages from one housing to another. With a view to ensuring the sealing, the unperforated zone 29, which consists of the same metal sheet as the perforated bottom 23 of the housing 21, may be coated with a resilient material layer.

The unperforated zone 29 may equally be made of resilient material alone, for instance of rubber, in which case compressed air may be introduced into the space between the front and rear walls 22 of two housings 21, which then inflates the rubber at the unperforated zone 29 to lie tightly against the top edge of the lamellae 27. In view of this mode of sealing there has been depicted in FIG. 6, with interrupted lines, a connector 34 for introducing compressed air into the hollow space defined by the front and rear walls of the housings 21.

In order that there could be no leakage at the ends of the drum 1 either, the housings 21 carry seals 30, parallelling the circumference, against the annular rails 4 (FIG. 2).

The means of the invention furthermore comprises a feeding means 31 external to the drum, for introducing the cellulose pulp on the surface of the drum in the form of a web, which is divided into compartments formed by the lamellae 27, and a channel 33 with conveyor 32 for removing the washed web from the means.

The means of the invention operates as follows.

The pulp stock coming from the cellulose digestion process and which may have a consistency e.g. of 1 to 4%, is supplied under pressure to a separate feeding means 31, whence it is transferred, at the same time concentrating it to dry content between 8 and 12%, continuously, into the compartments between the lamellae 27. The feeding means 31 being sealed to be pressure-tight against the drum 1, liquid will be expressed from the fibre web as this web comes against the drum, this liquid entering the compartments 9 adjacent to the feeding aperture of the feeding means and passing thence into the pipes 10, of which there are two adjacent to the mouth of the feeding means 31, as shown in FIG. 1. From these pipes 10, the dirtiest suspension liquid expressed from the pulp layer is collected in the draining pipe 20 (FIG. 5).

The remaining part of the suspension liquid contained in the fibre web with constant consistency is removed by performing a displacement washing process in accordance with the counter-current principle, in that into the housing 21 which is last in the direction of rotation of the drum there is introduced through the connector 25 the pressurized, completely pure washing liquid. This liquid passes through the bottom perforations 24 of the housing 21 to meet the pulp web in the compartments between lamellae 27, pushing into the pores between fibres and displacing such suspension as still remains in them, which passes through the filter 6 and through the holes 5 in the drum 1 into the compartments 9 under the housing 21 at this point, a pipe 10 leading from each such compartment to the valve 11 at one end of the drum, and through the holes 13 of this valve the collected suspension liquid displaced from within the pulp web gains access through the hole 15 in the stationary half 14 of the valve 11 into the pipe 16 affixed outside the valve 11. This pipe has by its other end been attached to the housing preceding the housing 21 which is last in the direction of rotation of the drum and having equal volume (FIGS. 1 and 5). When from the connector 25 the pure washing liquid is pumped into the housing 21 under sufficient pressure, it becomes possible to transport the suspension liquid thereby displaced, as the drum rotates, by this single pumping, from each housing to the next up to the housing lying closest to the feeding means 31, whence it passes further against the pulp web, displacing therefrom the dirtiest suspension liquid into the compartments 9 under this last box 21, and whence the pipes 10 in above-described manner conduct it to the draining pipe 25 and thence out of the means, to the next process step, for instance to be evaporated. It is also possible to combine with this drain flow of the dirtiest suspension liquid, that liquid which comes from the draining pipe 20.

As described in the foregoing, no leakage can take place from one housing into the other owing to the unperforated zones 29 of the housing bottoms. Such an unperforated zone 29 is also utilized in the discharging of the washed pulp from the compartments between lamellae 27 into the channel 33. Since the housing 21 at this point has at its end just preceding the channel 33 been provided with an unperforated zone 29 between the wall 22 and the end 22' and onto which is blown by the pipe 18 and through the hole 17 and holes 13, compressed air into the pipes 10, there will be produced, in the last compartment between lamellae 27 facing the unperforated region 29, an over-pressure of such height that as it is discharged the pulp web will become detached from the wire 6 and fall, as the drum continues to rotate, into the channel 33, whence it is carried off by the conveyor screw 32.

The following advantages are gained by the aid of the means of the invention.

By conducting the pure washing liquid under pressure and in accordance with the counter-current principle from one housing to the next, one achieves a good washing result with a small amount of liquid when the housings are mutually isolated, whereby it becomes possible to employ one single pumping to the purpose of transporting the washing liquid from one step to the next. This obviates the separate tanks which were required in connection with means of prior art, for the collection of the suspension liquids coming from different washing steps. The dirtiest fraction displaced from within the pulp web is recovered, by the means of the invention, in a highly concentrated condition because the quantity of added washing liquid is small. This circumstance possesses great significance regarding for instance the subsequent evaporation of the black liquor obtained in sulphate cellulose digestion. Moreover, it is easy to regulate the capacity of the washing means within wide limits by changing the speed of rotation of the drum and the pressure of the washing liquid.

I claim:

1. In an apparatus for washing cellulose pulp, including a drum with open ends rotating about a horizontal axis and onto the surface of which the cellulose is introduced in the form of a continuous fibre web, said drum having an outer shell which is coated with a wire fabric serving as filtering member for the web, and having stationary housings provided with a perforated bottom and having the same length as the drum, said drum having an outside encircled by said housings for introducing a pressurized washing liquid against the fibre web upon the wire fabric, and compartments affixed within the drum and formed by partitions with a length equalling that of the drum for receiving a suspension liquid displaced by the washing liquid from within the fibre web, each housing being provided with a washing liquid input connector and the compartments being provided with draining pipes for the displaced suspension liquid, and the housings being isolated from each other in the direction of rotation of the drum by means of front and rear walls, the pure washing liquid introduced through the connector of the housing which is last in the direction of rotation of the drum passing through the holes in the bottom to meet the fibre web, forcing an equivalent quantity of suspension liquid contained in the fibre web to pass through the wire fabric and through the holes in the drum's shell into the compartments under the housing and through the draining pipes to a valve on the axis at one end of the drum, said valve combining the suspension liquid flows coming from a plurality of compartments and conducting them to the supply connector, connected to the outer surface of the valve, of the last but one housing in the direction of rotation of the drum, whereafter this displaced suspension liquid in its turn displaces, under pressure, suspension liquid from within the pulp web, the flow resistances encountered by the washing liquid between the different housings causing a differential pressure between the washing liquids in different housings, and radial lamellae for inhibiting leakage of washing liquid thereby caused directly from one housing to the next, or leakage of suspension liquid displaced from within the fibre web from one compartment to another, by cooperation of said radial lamellae on the surface of the drum and unperforated zones associated with the bottoms and adjacent to the front and rear walls of the housings, wherein the improvement comprises that the mutual spacing of the lamellae on the continuation of the partitions, on the drum circumference, is less than the length of the unperforated zone, so that as the drum rotates there is at any time at least one of the lamellae in sealing contact with each unperforated zone located between the front and rear walls of each housing.

2. Apparatus according to claim 1, wherein said lamellae carry on their free ends, sealing strips made of a resilient, wear-resistant material.

3. Apparatus according to claim 1, wherein said unperforated zones are made of a resilient, wear-resistant material which presses tightly against the sealing strips of the lamellae.

4. Apparatus according to claim 3, wherein the zone consists of the same sheet as the bottoms of the housings, which have been coated with a layer made of a resilient material.

5. Apparatus according to claim 3, wherein the zone has been made of rubber which becomes inflated against the lamellae when compressed air is introduced through a connector into the enclosed space defined by the walls.

* * * * *